US009004166B2

(12) United States Patent
Raglin

(10) Patent No.: US 9,004,166 B2
(45) Date of Patent: Apr. 14, 2015

(54) DOWN-HOLE GAS SEPARATOR

(75) Inventor: John M. Raglin, Midland, TX (US)

(73) Assignee: Spirit Global Energy Solutions, Inc., Midland, TX (US)

( * ) Notice: Subject to any disclaimer, the term of this patent is extended or adjusted under 35 U.S.C. 154(b) by 694 days.

(21) Appl. No.: 13/195,441

(22) Filed: Aug. 1, 2011

(65) Prior Publication Data

US 2013/0032341 A1 Feb. 7, 2013

(51) Int. Cl.
*E21B 43/38* (2006.01)
*E21B 43/12* (2006.01)

(52) U.S. Cl.
CPC ..... *E21B 43/127* (2013.01); *E21B 43/38* (2013.01)

(58) Field of Classification Search
CPC ..... E21B 43/38
USPC ..... 166/105.5, 265
See application file for complete search history.

(56) References Cited

U.S. PATENT DOCUMENTS 2,883,940 A * 4/1959 Gibson ..... 166/105.5
5,482,117 A * 1/1996 Kolpak et al. ..... 166/265
5,579,838 A * 12/1996 Michael ..... 166/106
6,959,764 B2 * 11/2005 Preston ..... 166/265
2002/0023750 A1 * 2/2002 Lopes et al. ..... 166/265
2005/0081718 A1 4/2005 Carruth
2005/0274515 A1 * 12/2005 Smith et al. ..... 166/265

* cited by examiner

*Primary Examiner* — Giovanna Wright
*Assistant Examiner* — Richard Alker
(74) *Attorney, Agent, or Firm* — Bell Nunnally & Martin LLP; Craig J. Cox

(57) ABSTRACT

A gas separator for separating gas from a fluid in a production stream in a producing hydrocarbon well is described. The gas separator includes a central tube sized to fit into a well casing of the producing hydrocarbon well and having an input at its lower end for receiving the production stream and perforations at its upper end to allow the production stream to flow into the space between the central tube and the well casing. A suction tube is located inside the central tube, the suction tube is operable to draw fluid from the space between the central tube and the well casing and to deliver the fluid to an artificial lift mechanism. A baffle assembly in the gas separator is comprised of a series of baffles, each baffle extending between an inner wall of the central tube and an outer wall of the suction tube for a portion of the available space between the inner wall of the central tube and the outer wall of the suction tube, each baffle offset from the other baffles in the baffle assembly, wherein the baffle assembly is operable to continually redirect the fluid and gas as it travels through the central tube.

23 Claims, 2 Drawing Sheets

DOWN-HOLE GAS SEPARATOR

TECHNICAL FIELD

The present disclosure is directed to petroleum producing and injection wells and more particularly to the separation of gas and liquid from a hydrocarbon production stream.

BACKGROUND OF THE INVENTION

Petroleum wells can be naturally flowing, injecting or can be produced by any means of artificial lift. The hydrocarbon production stream can include both liquid and gaseous products that are a natural byproduct of the producing wells. As hydrocarbons and water flow through the formation, gases can travel in the flow stream either separate from the liquid products or dissolved within the liquid products. The gases are carried into the production tubing and can cause problems with artificial lifting mechanisms, such as rod pumps, by reducing the volumetric efficiency of the pump.

Gas interference occurs in situations when the pump is filling with a considerable amount of free gas that is not separated before entering the pump. If the amount of free gas entering the pump can be reduced, the volumetric efficiency of the pump is improved or the total pump capacity can be increased.

To be effective, a gas separation scheme for a hydrocarbon well should provide an opportunity and space for gas dissolved or entrained in the oil to free itself from the liquid. To accomplish this, the pump intake velocity of the fluid should preferably be adjusted to a rate that is near to or less than the rate at which gas bubbles can flow through the liquid. This range is approximately 0.4 to 1.2 feet/second, with the preferable range being 0.4 to 0.7 feet/second. Also, the well should provide enough storage space for the gas free liquid in the well case so that the well 'heads up' and produces extremely high percentages of gas intermittently.

BRIEF SUMMARY OF THE INVENTION

A gas separator for separating gas from a fluid in a production stream in a producing hydrocarbon well is described. The gas separator includes a central tube sized to fit into a well casing of the producing hydrocarbon well and having an input at its lower end for receiving the production stream and perforations at its upper end to allow the production stream to flow into the space between the central tube and the well casing. A suction tube is located inside the central tube, the suction tube is operable to draw fluid from the space between the central tube and the well casing and to deliver the fluid to an artificial lift mechanism. A baffle assembly in the gas separator is comprised of a series of baffles, each baffle extending between an inner wall of the central tube and an outer wall of the suction tube for a portion of the available space between the inner wall of the central tube and the outer wall of the suction tube, each baffle offset from the other baffles in the baffle assembly, wherein the baffle assembly is operable to continually redirect the fluid and gas as it travels through the central tube.

A method for separating gas from a fluid in a production stream in a producing hydrocarbon well is describe that uses a packer to direct the production stream into a central tube of a gas separator assembly. The method then continually redirects the flow of the production stream using a baffle assembly in the central tube and directs the production stream out of the central tube and into a space between a well casing of the hydrocarbon well and the central tube. The method also includes creating a flow rate of in the range of 0.4 to 1.2 feet/second, and preferably in the range of 0.4 to 0.7 feet/second, in the space between a well casing of the hydrocarbon well and the central tube; and drawing the fluid from the production stream into a suction tube running through the interior of the central tube, the suction tube delivering the fluid to an artificial lift mechanism.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figures 1A, 1B, 1C, 1D:
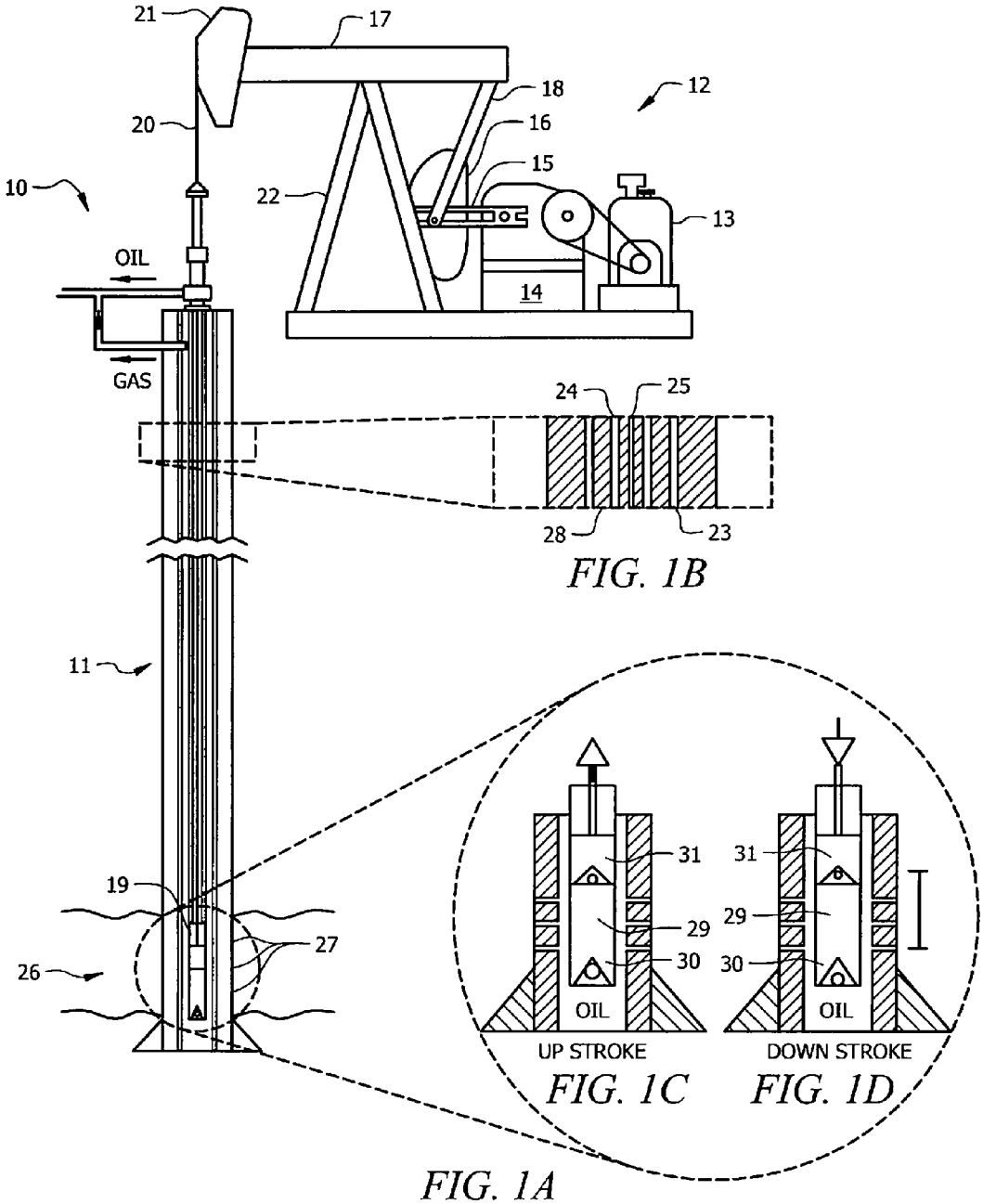
FIG. 1A (Prior Art)
FIG. 1A is a diagram of a prior art petroleum producing well showing an existing sucker rod pump assembly to provide artificial lift.
FIG. 1B is a sectional view of the well string shown in FIG. 1A.
FIG. 1C is a detail view of the plunger portion of the well of FIG. 1A showing the up stroke.
FIG. 1D is a detail view of the plunger portion of the well of FIG. 1A showing the down stroke.

Referring now to FIG. 1, a diagram of a typical sucker rod pump used in oil wells is described. The sucker rod pump is described only for the purposes of illustrating the operation of a typical oil well and is not intended to be limiting in any manner as the present invention is applicable to any producing oil well including those using any means of artificial lift, such as rod pumping, electric submersible pumps, progressive cavity, and other methods.

Well 10 includes well bore 11 and pump assembly 12. Pump assembly 12 is formed by a motor 13 that supplies power to a gear box 14. Gear box 14 is operable to reduce the angular velocity produced by motor 13 and to increase the torque relative to the input of motor 13. The input of motor 13 is used to turn crank 15 and lift counter weight 16. As crank 15 is connected to walking beam 17 via pitman arm 18, walking beam 17 pivots and submerges plunger 19 in well bore 11 using bridle 20 connected to walking beam 18 by horse head 21. Walking beam 17 is supported by sampson post 22.

Well bore 11 includes casing 23 and tubing 24 extending inside casing 23. Sucker rod 25 extends through the interior of tubing 24 to plunger 19. At the bottom of well bore 11 in oil bearing region 26, casing 23 includes perforations 27 that allow hydrocarbons and other material to enter annulus 28 between casing 23 and tubing 24. Gas is permitted to separate from the liquid products and travel up the annulus where it is captured. Liquid well products collect around pump barrel 29, which contains standing valve 30. Plunger 19 includes traveling valve 31. During the down stroke of the plunger, traveling valve is opened and product in the pump barrel is forced into the interior of tubing 24. When the pump begins its upstroke, traveling valve 31 is closed and the material in the tubing is forced up the tubing by the motion of plunger 19. Also during the upstroke, standing valve 30 is opened and material flows from the annulus in the oil bearing region and into the pump barrel.

As can be seen from FIG. 1, where the product flowing into the well bore contains entrained and free gas, that gas can enter the pump and reduce the volumetric efficiency of the pump. The gas separator of the present invention provides mechanisms for both reducing the amount of gas entrained in the liquid and separating that free gas from the liquid product. In preferred embodiments, the mechanism uses a packer type separator to create an artificial sump for the pump.

Figure 2:
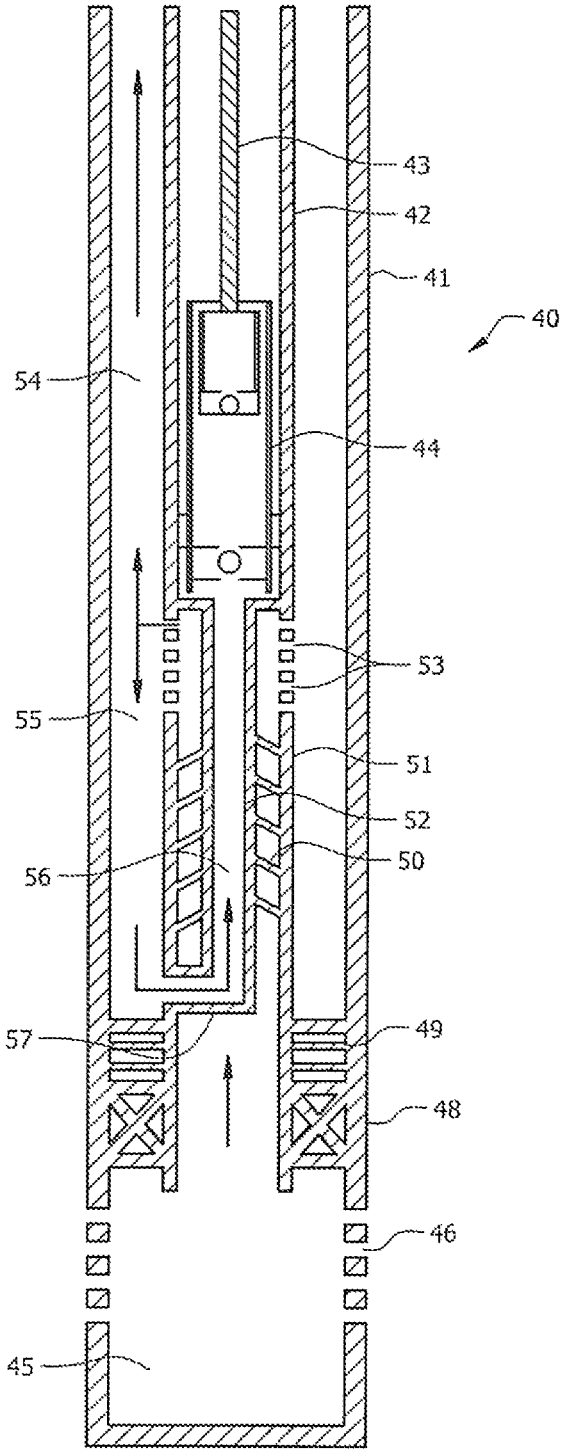
FIG. 2 is a diagram of the preferred embodiment of a gas separator according to the concepts described herein.

Referring now to FIG. 2, a preferred embodiment of a gas separator according to the concepts described herein is shown. The separator assembly 40 is installed into the tubing string or delivery conduit of a well producing hydrocarbons. Assembly 40 can be of any appropriate length, but is preferably 20 to 40 feet long depending upon the application. Preferred embodiments of assembly 40 are designed and constructed as a single welded piece with no threaded parts, o-rings, or mechanical pieces. This type of construction is preferred to minimize problems and malfunctions in the harsh down-hole environment of a producing oil well.

Gas separator assembly 40 is placed into well casing 41. Tubing anchor 48 and packer 49 are used to anchor gas separator assembly 40 and to provide an artificial sump for pump 44. Gas separator assembly 40 is formed by center tube 51 and inner suction tube 52. Intake tube 57 provides a fluid path from the outside of the outer casing 41 to suction tube 52 and pump 44. Each of the individual baffles 50 preferably fills 180 degrees, or 50 percent, of the space between an inner surface of center tube 51 and the outer surface of suction tube 52. The baffles 50 are offset from each other and staggered to provide a turbulent flow path for fluid up the inner space of center tube 51. The baffles may also be angled relative to the direction of flow. Tubing perforations 53 provide a flow path from the interior of outer casing 41 to the space between the center tube 51 and well casing 41. Fluid must flow out these perforations as the outer casing above the perforations 53 is blocked by the bottom of pump assembly 40.

In operation, liquid and gas products of the well enter the well casing through perforations 46 and collect in well bore 45. The liquid and gas are directed into the gas separator assembly 40 by tubing anchor 48 and packer 49. The liquid and gas then pass through baffles 50 that run the length of the center tube 51 until it is blocked by a flow diverter at the top of the separator and directed out of tube perforations 53. Baffles 50 are each preferably offset, that is welded 180 degrees apart, and staggered vertically. This assembly is used to "tumble" and redirect the fluid and gas. This turbulence works to "break-out" the gas from solution. Series of pressure drops across baffles 50 will also assist to "release" the gas from the liquid.

The gas and liquid will exit the baffles 50 through tubing perforations 53 and enter the space between the central tube 51 and the well casing 41. Free gas will flow upward through path 54 and liquid products will flow down. As stated, the packer will provide a floor for the liquid product and create an artificial sump 55 from which pump 44 can draw. Fluid is drawn through intake tube 57 into suction tube 52 in the interior or central tube 51 along flow path 56. Pump 44 using rod 43 will pull liquid product up from sump 55 and deliver it to the surface through inner tube 42.

The pump intake should be managed to control the rate of fluid flow in sump 55. Preferably, the fluid velocity in sump 55 should be in the range of 0.4 to 1.2 feet/second, with a slower velocity in the range of 0.4 to 0.7 feet/second preferable. This range represents the preferred range to allow gas bubbles suspended in oil to rise through the fluid flow, and a fluid velocity of within this range or less allows the free gas to separate from the liquid stream before entering the suction tube 56 and pump 44. The fluid velocity in sump 55 can be affected by choosing the diameters of center tube 51 relative to well casing 41 and by choosing a larger diameter intake tube 57 and suction tube 56.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A gas separator for separating gas from a fluid in a production stream in a producing hydrocarbon well, the gas separator comprising:

a central tube, the central tube being sized to fit into a well casing of the producing hydrocarbon well and having an input at its lower end for receiving the production stream and perforations at its upper end to allow the production stream to flow into the space between the central tube and the well casing;

a suction tube inside the central tube, the suction tube operable to draw fluid from the space between the central tube and the well casing and to deliver the fluid to an artificial lift mechanism;

a baffle assembly comprising a series of baffles, each baffle extending between an inner wall of the central tube and an outer wall of the suction tube for a portion of the available space between the inner wall of the central tube and the outer wall of the suction tube, each baffle offset from the other baffles in the baffle assembly, each baffle being angled upward from the inner wall of the central tube to the outer wall of the suction tube and blocking about half of the available space for fluid flow, such that the baffle assembly continually redirects the fluid and gas toward a next baffle in the baffle assembly as the fluid and gas it travels through the central tube.

2. The gas separator of claim 1 wherein the gas separator is held in the well casing by a tubing anchor and a packer assembly.

3. The gas separator of claim 1 wherein the packer creates an artificial sump adjacent to the suction tube intake.

4. The gas separator of claim 1 wherein the baffle assembly creates turbulence in the production stream that works to separate the gas from the fluid.

5. The gas separator of claim 1 wherein the artificial lift mechanism is a rod pump.

6. The gas separator of claim 1 wherein the artificial lift mechanism is a submersible pump.

7. The gas separator of claim 1 wherein the artificial lift mechanism is a progressive cavity pump.

8. The gas separator of claim 1 wherein the flow rate of the fluid in the space between the central tube and the well casing is no more than 1.2 feet/second.

9. The gas separator of claim 1 wherein the flow rate of the fluid in the space between the central tube and the well casing is no more than 0.7 feet/second.

10. The gas separator of claim 1 wherein the flow rate of the fluid in the space between the central tube and the well casing is no more than 0.4 feet/second.

11. The gas separator of claim 1 wherein the gas separator is at least 20 feet long.

12. The gas separator of claim 1 wherein the gas separator is at least 40 feet long.

13. A method for separating gas from a fluid in a production stream in a producing hydrocarbon well, the method comprising:

using a packer to direct the production stream into a central tube of a gas separator assembly;

continually redirecting the flow of the production stream using a baffle assembly in the central tube, wherein the baffle assembly comprises a series of baffles, each baffle extending between an inner wall of the central tube and an outer wall of the suction tube for a portion of the available space between the inner wall of the central tube and the outer wall of the suction tube, each baffle offset from the other baffles in the baffle assembly, each baffle being angled upward from the inner wall of the central tube to the outer wall of the suction tube and blocking about half of the available space for fluid flow, such that the baffle assembly continually redirects the fluid and gas toward a next baffle in the baffle assembly as the fluid and gas travels through the central tube;

directing the production stream out of the central tube and into a space between a well casing of the hydrocarbon well and the central tube where the gas can separate from fluid; and drawing the fluid from the production stream into a suction tube running through the interior of the central tube, the suction tube delivering the fluid to an artificial lift mechanism.

14. The method of claim 13 wherein the baffle assembly creates turbulence in the production stream that works to separate the gas from the fluid.

15. The method of claim 13 wherein the packer creates an artificial sump adjacent to the suction tube intake.

16. The method of claim 13 wherein the artificial lift mechanism is a rod pump.

17. The method of claim 13 wherein the artificial lift mechanism is a submersible pump.

18. The method of claim 13 wherein the artificial lift mechanism is a progressive cavity pump.

19. The method of claim 13 wherein the gas separator is at least 20 feet long.

20. The method of claim 13 wherein the gas separator is at least 40 feet long.

21. The method of claim 13 further comprising creating a flow rate less than 1.2 feet/second in the space between the well casing of the hydrocarbon well and the central tube.

22. The method of claim 13 further comprising creating a flow rate less than 0.7 feet/second in the space between the well casing of the hydrocarbon well and the central tube.

23. The method of claim 13 further comprising creating a flow rate less than 0.4 feet/second in the space between the well casing of the hydrocarbon well and the central tube.

* * * * *